United States Patent [19]

Dennis

[11] 4,334,209

[45] Jun. 8, 1982

[54] GLASS ENCLOSED THREE LEAD CIRCUIT BREAKER

[75] Inventor: Philip J. Dennis, Cape Elizabeth, Me.

[73] Assignee: GTE Products Corporation, Stamford, Conn.

[21] Appl. No.: 209,342

[22] Filed: Nov. 21, 1980

Related U.S. Application Data

[63] Continuation of Ser. No. 36,196, May 4, 1979.

[51] Int. Cl.[3] ..... H01H 45/02; H01H 61/02

[52] U.S. Cl. ..... 337/112; 337/102

[58] Field of Search ..... 337/112, 89, 102

[56] References Cited

U.S. PATENT DOCUMENTS 3,474,372 10/1969 Davenport et al. ..... 337/112

3,555,478 1/1971 Dennis ..... 337/112

3,573,697 4/1971 Dennis et al. ..... 337/89

*Primary Examiner*—Harold Broome

*Attorney, Agent, or Firm*—James Theodosopoulos

[57] ABSTRACT

A circuit breaker comprises a hermetically sealed glass envelope having three lead-in wires extending therethrough. Within the envelope, a stationary contact is fastened to one of the wires, a thermostatic element to another of the wires, and a heater to the third wire. The circuit breaker permits simultaneous protection of two windings of a motor, for example, the main winding and the start winding. The thermostatic element provides protection for one of the windings and the combination of the thermostatic element and heater provides protection for the other.

2 Claims, 1 Drawing Figure

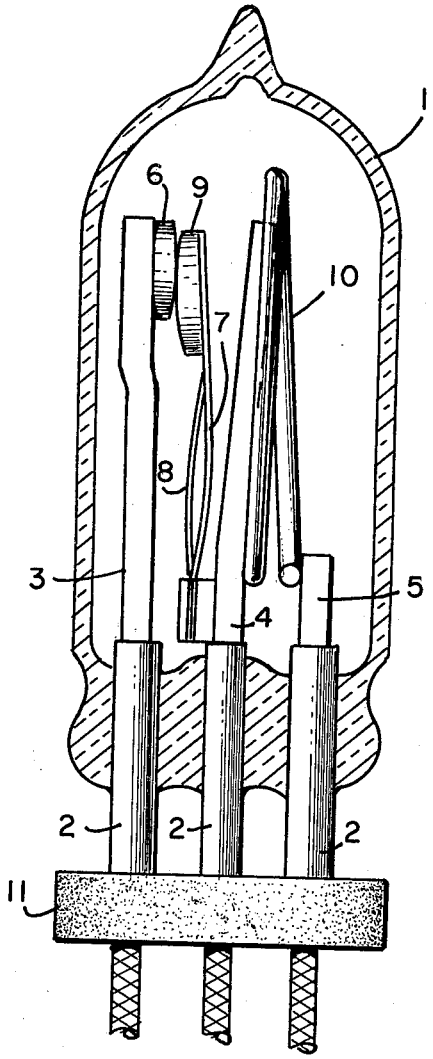
1
6
9
10
7
8
3
5
4
2
2
2
11

GLASS ENCLOSED THREE LEAD CIRCUIT BREAKER

This is a continuation of application Ser. No. 036,196, filed May 4, 1979.

THE INVENTION

This invention concerns circuit breakers which are disposed within a hermetically sealed glass envelope. U.S. Pat. No. 3,573,697 shows an example of such a circuit breaker which, in operation, is connected in series with the main winding of a motor.

The instant invention provides a circuit breaker similar to that in U.S. Pat. No. 3,573,697 but which also contains additional features to provide protection for the start winding of a motor. Thus, the circuit breaker contains three lead-in wires, instead of two, the third lead-in wire being provided for connection to the start winding of a motor. The internal connection of the third lead-in wire is made to a heater within the circuit breaker envelope which will break the circuit in the event that the motor starting relay fails to open at the proper time. The heater breaks the circuit by heating a thermostatic metallic element to its opening temperature.

The single FIGURE in the drawing is an elevational view, partly in section, of a circuit breaker in accordance with this invention.

As shown in the drawing, a circuit breaker in accordance with this invention comprises a hermetically sealed glass envelope 1 having three readily sealable metal tubes 2 made, for example, of kovar, sealed to and extending through the base of envelope 1. Lead-in wires 3, 4 and 5 made, for example, of copper clad steel, extend through and are sealed, for example, by brazing, to the respective three metal tubes 2. At the internal end of lead-in wire 3 there is a stationary contact 6. Fastened to the internal portion of lead-in wire 4 is a snap element assembly consisting of thermostatic snap-acting metallic element 7 and a shunt 8 in parallel therewith, similar to that shown in U.S. Pat. No. 3,573,697. At the internal end of the snap element assembly there is attached to so-called movable contact 9. When the circuit breaker is closed, movable contact 9 is in physical and electrical contact with stationary contact 6. When thermostatic element 7 opens, it moves contact with stationary contact 6.

Fastened between the internal portions of lead-in wires 4 and 5 is an electrical heater 10. Heater 10 is in close proximity to thermostatic element 7 and in series therewith. Thus when there is current flow in heater 10, it will generate heat which will be radiated to thermostatic element 7 which, when heated to its opening temperature, will snap open, terminating the current flow. In one example, heater 10 was made of 40 mil niron (50–52% nickel, balance iron) wire, was 2½ inches long and contoured to fit in envelope 1 proximate bimetal 7. Envelope 1 was about 1½ inches long by 11/16 inches in diameter.

The metal tubes 2 extend into close-fitting holes in a retainer 11 made of insulative material. The purpose of retainer 11 is to prevent stresses from being imparted to the glass-to-metal seal region of envelope 1 when the circuit breaker is fastened to the windings of a motor, generally by tying, since the cord used for tying is wound around the metal tubes 2 as wellas envelope 1. Only one tube 2 need be fastened to retainer 11, such as by bonding with a suitable cement, but all three may be fastened if desired.

In operation, lead-in wire 3 is connected to a power source, lead-in wire 4 is connected to the main winding of a motor and lead-in wire 5 is connected to the start winding of the motor. Thus, the starting current will pass through heater 10 and the starting current plus main winding current will pass through bimetal 7 plus shunt 8.

In operation, where the circuit breaker is connected to, say, a 2 horsepower compressor motor, there will be about 30–40 amperes of current in the start winding of the motor which will also pass through heater 10 in the circuit breaker. If there is a malfunction, and the starter relay falls to open at the proper time, say, about one second, heater 10 will heat bimetal 7 to its opening temperature, for example, 110° C. in about 5 seconds and current flow to the motor will be terminated. Under normal operation, the starter relay will open at the proper time and there will no longer be current flow through heater 10. The current flow through the main winding of the motor, which is about 20 amperes in the above example, will flow through bimetal 7 plus shunt 8, which will protect the motor from current overload.

I claim:

1. A circuit breaker comprising: a hermetically sealed glass envelope; three spaced apart metal tubes sealed to one end of said envelope, said metal tubes being readily sealable to glass, a metal lead-in wire disposed within each of said metal tubes and being hermetically joined thereto and extending beyond the ends thereof; a stationary contact within the envelope attached to a first one of the lead-in wires; a theremostatic metallic element having a movable contact at one end thereof within the envelope attached to the second of the lead-in wires; a heater within the envelope isolated from said first lead-in wire and attached between said second lead-in wire and the third of the lead-in wires, the heater being in series with the thermostatic metallic element and being in heat radiating proximity thereto; the contact during normal operation being closed, the heater being operative to open the contact when starting current flows through the heater longer than a predetermined time, the thermostatic metallic element being operative to open the contacts when more than a predetermined amount of current flows through the thermostatic metallic element.

2. The circuit breaker of claim 1 wherein the lead-in wires are disposed in an external retainer in such a manner as to prevent stresses from being imparted to the glass envelope when the circuit breaker is attached to apparatus to be protected.

* * * * *